US008647144B2

(12) United States Patent
Wakao et al.

(10) Patent No.: US 8,647,144 B2
(45) Date of Patent: Feb. 11, 2014

(54) CONNECTOR HAVING GUIDE MEMBER SUPPORTED BY PLUG AND JACK WHEN THEY ARE CONNECTED, AND CONNECTOR CONNECTING METHOD

(75) Inventors: Manabu Wakao, Kawasaki (JP); Kouichi Kuramitsu, Kawasaki (JP); Kenji Tsutsumi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 13/480,201

(22) Filed: May 24, 2012

(65) Prior Publication Data

US 2012/0231651 A1 Sep. 13, 2012

Related U.S. Application Data

(63) Continuation of application No. PCT/JP2009/070595, filed on Dec. 9, 2009.

(51) Int. Cl.
*H01R 13/64* (2006.01)

(52) U.S. Cl.
USPC ..... 439/374; 439/157

(58) Field of Classification Search
USPC ..... 439/157, 246, 247, 261, 310, 362, 372, 439/374, 376, 377
See application file for complete search history.

(56) References Cited

U.S. PATENT DOCUMENTS 3,453,586 A * 7/1969 Brendlen, Jr. ..... 439/153
5,395,258 A * 3/1995 Okumura et al. ..... 439/157
5,431,573 A 7/1995 Endo et al.
5,599,200 A 2/1997 Yagi et al.
6,254,414 B1 7/2001 Sawayanagi et al.
7,066,763 B1 * 6/2006 Corwin et al. ..... 439/372

FOREIGN PATENT DOCUMENTS

| | | |
|---|---|---|
| JP | 04-026084 | 1/1992 |
| JP | 06-119955 | 4/1994 |
| JP | 06-140098 | 5/1994 |
| JP | 07-307186 | 11/1995 |
| JP | 11-040251 | 2/1999 |
| JP | 2001-068212 | 3/2001 |

OTHER PUBLICATIONS

Patent Abstracts of Japan, Publication No. 04-026084, Published Jan. 29, 1992.
Patent Abstracts of Japan, Publication No. 07-307186, Published Nov. 21, 1995.
Patent Abstracts of Japan, Publication No. 06-119955, Published Apr. 28, 1994.

(Continued)

*Primary Examiner* — Tho D Ta
(74) *Attorney, Agent, or Firm* — Staas & Halsey LLP

(57) ABSTRACT

A plug of a connector includes plug-side electrode terminals arranged therein, the plug having a first engagement part on one end side in a direction of arrangement of the plug-side electrode terminals and a second engagement part on the other end side. A jack of the connector includes jack-side electrode terminals arranged therein, the jack having a third engagement part on one end side in a direction of arrangement of the jack-side electrode terminals and a fourth engagement part on the other end side. A guide member has a fifth engagement part and a sixth engagement part, the fifth engagement part configured to engage with the first engagement part of the plug and the third engagement part of the jack, the sixth engagement part configured to engage with the second engagement part of the plug and the fourth engagement part of the jack.

9 Claims, 19 Drawing Sheets

(56) References Cited

OTHER PUBLICATIONS

Patent Abstracts of Japan, Publication No. 06-140098, Published May 20, 1994.
Patent Abstracts of Japan, Publication No. 11-040251, Published Feb. 12, 1999.
Patent Abstracts of Japan, Publication No. 2001-068212, Published Mar. 16, 2001.
International Search Report mailed Jan. 12, 2010 in PCT/JP2009/070595.

* cited by examiner

CONNECTOR HAVING GUIDE MEMBER SUPPORTED BY PLUG AND JACK WHEN THEY ARE CONNECTED, AND CONNECTOR CONNECTING METHOD

CROSS-REFERENCE TO RELATED APPLICATIONS

This application is a U.S. continuation application, filed under 35 USC 111(a) and claiming the benefit under 35 USC 120 and 365(c), of PCT application JP2009/070595 filed Dec. 9, 2009. The foregoing application is hereby incorporated herein by reference.

FIELD

The embodiment discussed herein is directed to connectors and a method of connecting the connectors.

BACKGROUND

In recent years, densification in the device structures of electric devices or electronic devices has been progressed, while various kinds of functions are required for electric devices or electronic devices. Thus, the electric circuits and electronic circuits to be incorporated into the electric devices or the electronic devices have become complex. There are many cases in which two circuit boards are connected to each other or a function module is connected to a circuit board.

When connecting two circuit boards or connecting a function module to a circuit board, usually, a multi-pin connector having many pins is used. Generally, the multi-pin connector includes a plug and a jack (socket) so that the plug is fitted into the jack to achieve a mechanical connection and an electrical connection.

The multi-pin connector has directivity with respect to fitting of the plug and jack in many cases. The directivity in insertion and removal of the connector is determined by a direction of arrangement of the pins provided in the plug. For example, according to the connector having a directivity, the plug can be connected to the jack while slightly inclining the plug within a plane containing an extending direction of the pins and an aligning direction of the pins, but it is not desirable to connect the plug to the jack while inclining the plug in a direction other than the aforementioned direction. If an attempt is made to connect the plug to the jack while inclining the plug in a direction other than the direction within a plane containing extending direction of the pins and aligning direction of the pins, an excessive force may be applied to the pins, which may cause the pins to be bent or damaged.

Many connectors for connecting two circuit boards or connecting a functional module to a circuit board are mount-type connectors. Moreover, many mount-type connectors have a low height, which is referred to as a low-back type. That is, by using a connector having a low height, a distance between circuit boards connected to each other or a distance between a module and a board is reduced in order to increase a package density.

However, if the low-back type connector is used, there is a problem in that it is difficult to visually recognize the connector when connecting the connector. For example, if the connector is arranged in a middle portion of the circuit bard, the plug and the jack of the connector may be hidden in a position deep inside the space between the two circuit boards, which prevents the plug and the jack from being visually recognized easily. For this reason, the plug cannot be well-positioned relative to the jack, and there also may be a case where the plug cannot be connected according to the directivity of the connector. Similarly, in a case where a module is connected to a circuit board, the connector may be hidden in a space between the module and the circuit board, which prevents the plug and the jack from being visually recognized easily.

Thus, it is suggested in a Patent Document 1, for example, Japanese Laid-Open Patent Application No. H4-26084, to arrange a plug position correction tool around a jack to automatically guide the plug to a connecting position. The plug position connection tool is a member extending from a periphery of the jack toward a tip of the jack. The plug position correction tool is configured to have a structure in which a tip portion of the plug is first brought into contact with the plug position correction tool, and, then, the plug is guided to a position at which the plug is connected to the jack while the plug is slid along the plug position correction tool.

The plug position correction tool disclosed in the Patent Document 1 is capable of correcting the position in a range where the plug is very close to the jack, however, it cannot guides the plug to the position where the plug is very close to the jack (that is, to a position where a tip of the plug is brought into contact with the plug position correction tool). Thus, it is necessary to perform a connecting operation while visually recognizing the plug and the jack until the tip of the plug contacts the plug position correction tool. Accordingly, the problem that it is difficult to visually recognize the connector when connecting the connector still remains.

Moreover, the plug position correction tool disclosed in Patent Document 1 merely guide the plug to an accurate position, and the directivity of the connector is not taken into consideration. That is, because the plug position correction tool disclosed in Patent Document 1 cannot guide the plug along the connecting direction of the connector, there may be a case where an attempt is made to connect the plug to the jack in a wrong direction.

SUMMARY

According to an aspect of the invention, a connector includes: a plug including a plurality of plug-side electrode terminals arranged therein, the plug having a first engagement part on one end side in a direction of arrangement of the plug-side electrode terminals and a second engagement part on the other end side; and a jack including a plurality of jack-side electrode terminals arranged therein, the jack-side electrode terminals configured to be connected to the plug-side electrode terminals, the jack having a third engagement part on one end side in a direction of arrangement of the jack-side electrode terminals and a fourth engagement part on the other end side; and a guide member having a fifth engagement part and a sixth engagement part, the fifth engagement part configured to engage with the first engagement part of the plug and the third engagement part of the jack, the sixth engagement part configured to engage with the second engagement part of the plug and the fourth engagement part of the jack.

The object and advantages of the embodiment will be realized and attained by means of the elements and combinations particularly pointed out in the appended claims.

It is to be understood that both the foregoing general description and the following detailed description are exemplary explanatory only and are not restrictive of the invention, as claimed.

DESCRIPTION OF EMBODIMENT(S)

Preferred embodiment of the present invention will be explained with reference to the accompanying drawings.

Figure 1:
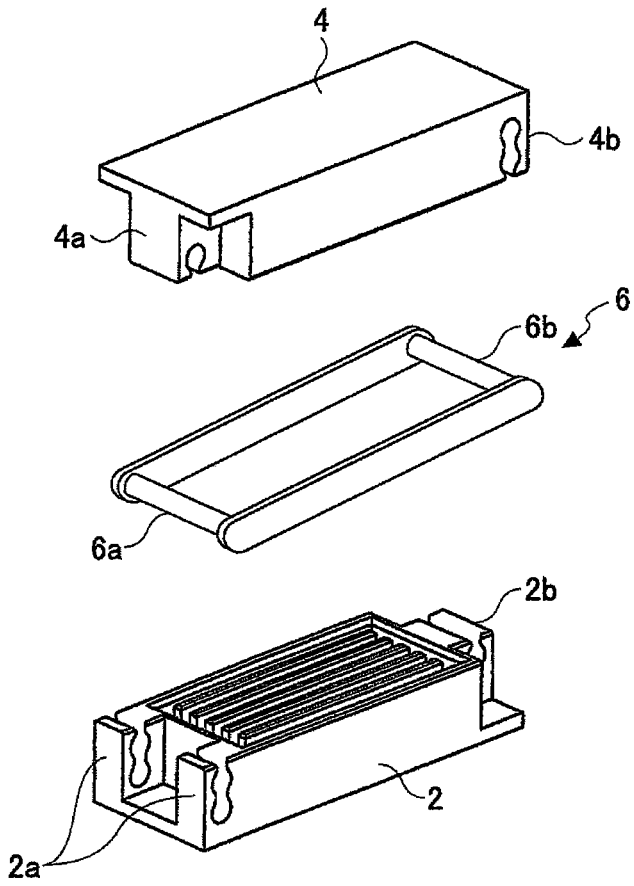
FIG. 1 is a perspective view of a connector according to a first embodiment.
Figure 2:
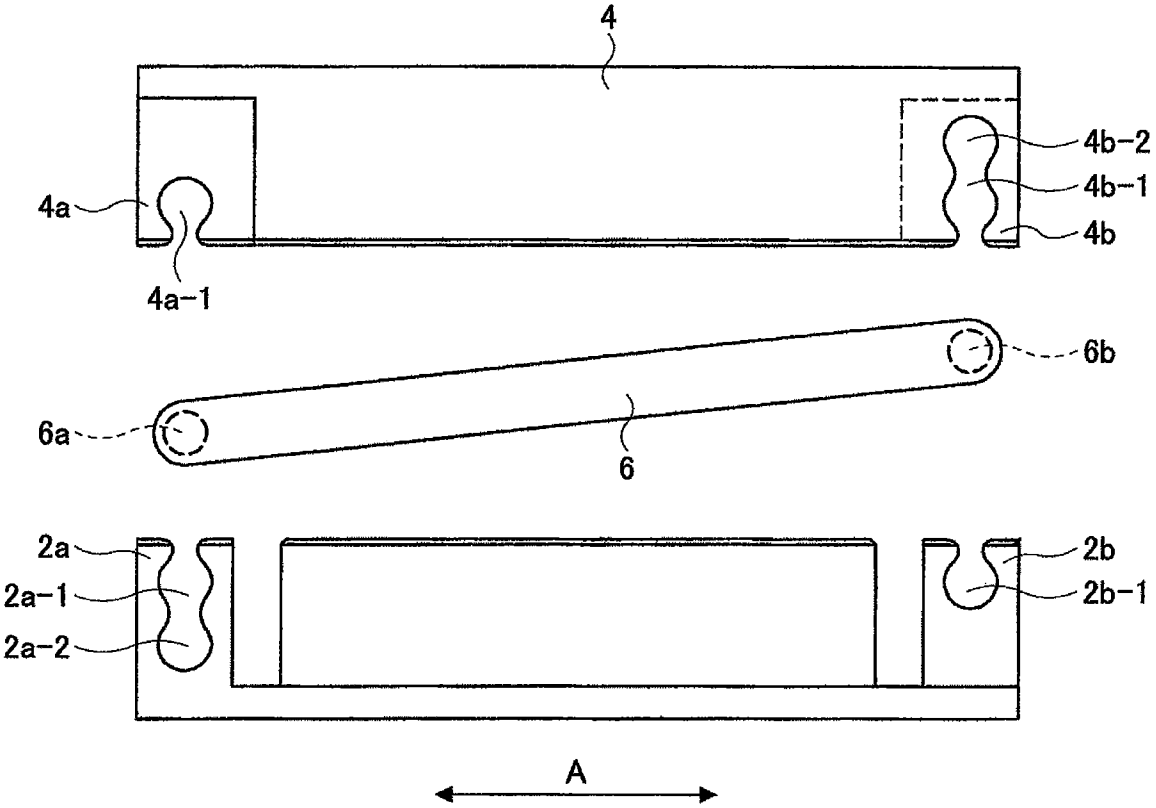
FIG. 2 is a side view of the connector according to the first embodiment.

A description will now be given of a case where a connector according to the first embodiment is used as a connector for connecting a module to a circuit board. FIG. 1 is a perspective view of the connector according to the first embodiment. FIG. 2 is a side view of the connector according to the first embodiment. The connector illustrated in FIG. 1 and FIG. 2 is a so-called stack connector, which includes a jack and a plug 4 inserted in the jack 2. The connector according to the present embodiment further includes a guide member 6. The guide member 6 includes a first engagement axis 6*a* (fifth engagement part), which is engageable with an engagement part 2*a* (third engagement part) of the jack 2 and an engagement part 4*a* (first engagement part) of the plug 4, and a second engagement axis 6*b* (sixth engagement part), which is engageable with an engagement part 4*b* (second engagement part) of the plug 4 and an engagement part 2*b* (fourth engagement part) of the jack 2.

Many electrode terminals are arranged inside the plug 4. When the plug 4 is inserted into the jack 2, the electrode terminals provided in the plug 4 are brought into contact with electrode terminals provided in the jack 2, which achieves an electrical connection. In the jack 2 and the plug 4, the electrode terminals are arranged in a direction of arrow A of FIG. 2 so that, when positioning the plug 4 to insert into the jack 2, the plug 4 can be moved closer to the jack while inclining the plug 4 in the direction of arrow A.

The engagement part 2*a* of the jack 2 has a fourth notch 2*a*-1 and a fifth notch 2*a*-2 that are provided in the vicinity of an end of the connector (jack 2) in the direction of arrow A. Each of the fourth notch 2*a*-1 and the fifth notch 2*a*-2 is a notch having a generally circular shape having a diameter slightly larger than an outer diameter of the first engagement axis 6*a* of the guide member 6. The fifth notch 2*a*-2 is formed to connect to the fourth notch 2*a*-1. A width of a portion where the fifth notch 2*a*-2 is connected to the fourth notch 2*a*-1 is slightly smaller than the outer diameter of the first engagement axis 6*a*. Accordingly, the first engagement axis 6*a* of the guide member 6 can be brought into engagement with the fifth notch 2*a*-2 by pressing the first engagement axis 6*a* with a certain force in a state where the first engagement axis 6*a* of the guide member 6 is in engagement with the fourth notch 2*a*-1.

The engagement part 4*a* of the plug 4 has a first notch 4*a*-1 provided in the vicinity of an end of the connector (plug 4) in the direction of arrow A. The first notch 4*a*-1 is a notch having a generally circular shape having a diameter slightly larger than the outer diameter of the first engagement axis 6*a* of the guide member 6 and a width of an opening part of the first notch 4*a*-1 is slightly smaller that the outer diameter of the first engagement axis 6*a*. Accordingly, the first engagement axis 6*a* of the guide member 6 can be brought into engagement with the first notch 4*a*-1 by pressing the first engagement axis 6*a* against the opening part of the first notch 4*a*-1.

The engagement part 2*b* of the jack 2 has a sixth notch 2*b*-1 provided in the vicinity of the other end of the connector (jack 2) in the direction of arrow A. The sixth notch 2*b*-1 is a notch having a generally circular shape having a diameter slightly larger than an outer diameter of the second engagement axis 6*b* of the guide member 6 and a width of an opening part of the sixth notch 2*b*-1 is slightly smaller that the outer diameter of the second engagement axis 6*b*. Accordingly, the second engagement axis 6*b* of the guide member 6 can be brought into engagement with the sixth notch 2*b*-1 by pressing the second engagement axis 6*b* against the opening part of the sixth notch 2*b*-1.

The engagement part 4*b* of the plug 4 has a second notch 4*b*-1 and a third notch 4*b*-2 that are provided in the vicinity of an end of the connector in the direction of arrow A (a right end in FIG. 2). Each of the second notch 4*b*-1 and the third notch 4*b*-2 is a notch having a generally circular shape having a diameter slightly larger than the outer diameter of the second engagement axis 6*b* of the guide member 6. The third notch 4*b*-2 is formed to connect to the second notch 4*b*-1. A width of a portion where the third notch 4*b*-2 is connected to the second notch 4*b*-1 is slightly smaller than the outer diameter of the second engagement axis 6*b*. Accordingly, the second engagement axis 6*b* of the guide member 6 can be brought into engagement with the third notch 4*b*-2 by pressing the second engagement axis 6*b* with a certain force in a state where the second engagement axis 6*b* of the guide member 6 is in engagement with the second notch 4*b*-1.

Figure 3A:
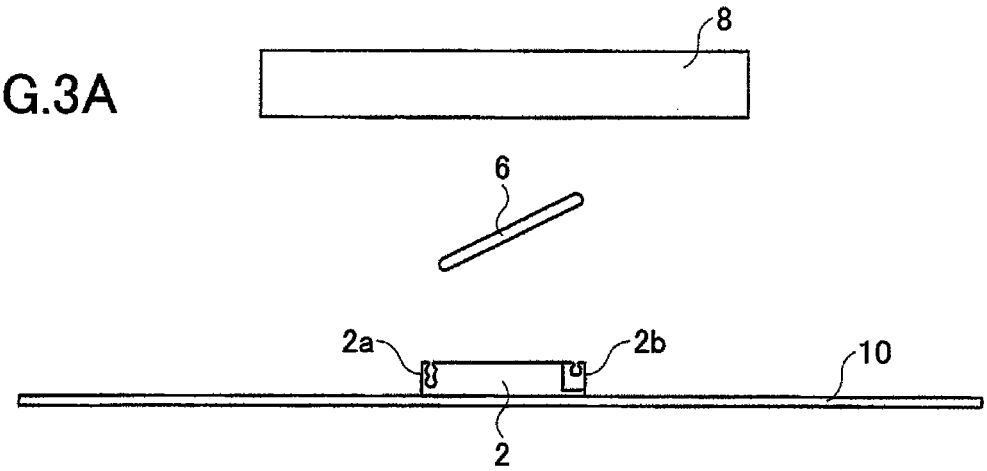
FIG. 3A is a side view illustrating a state before a module is connected to a circuit board.
Figure 3B:
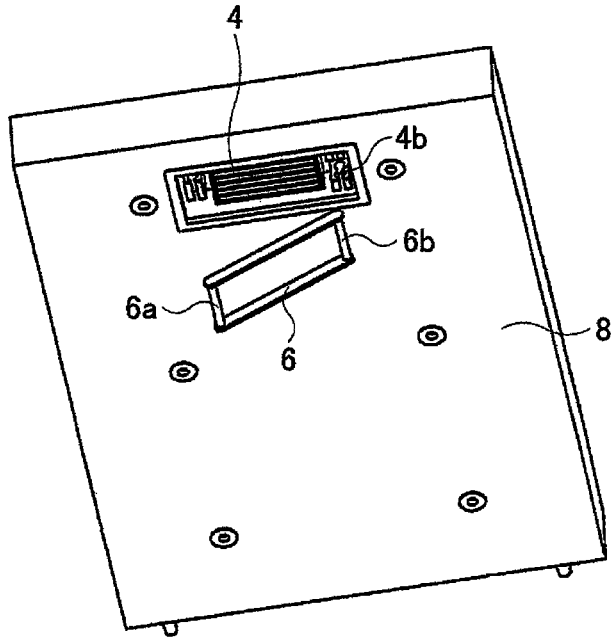
FIG. 3B is a perspective view illustrating a plug provided on the back surface of the module.
Figure 3C:
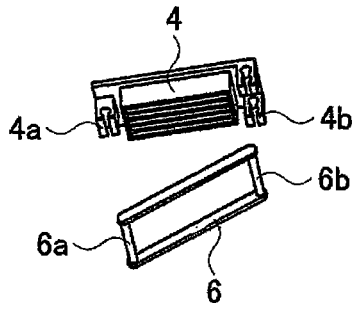
FIG. 3C is a perspective view of the plug and the guide member illustrated in FIG. 3B.

FIGS. 3A, 3B and 3C are views illustrating an example of connecting a module 8 to a circuit board 10 using the connector according to the present embodiment. FIG. 3A is a side view illustrating a state before the module 8 is connected to the circuit board 10. FIG. 3B is a perspective view illustrating the plug 4 provided on the back surface of the module 8. FIG. 3C is a perspective view of the plug 4 and the guide member 6 illustrated in FIG. 3B.

Because the plug 6 of the connector is embedded in the back surface of the module 8, the plug 6 does not appear in FIG. 3A. In FIG. 3A, the jack 2 of the connector mounted to the circuit board 10 is illustrated. In the state illustrated in FIG. 3A, the guide member 6 is has not yet attached to either of the plug 4 and the jack 2.

In FIG. 3A, in order to insert and connect the plug 4 of the module 8 to the jack 2 of the circuit board 10, the module 8 is moved closer to the circuit board 10 in the state where the plug 4 faces the jack 2. At this time, first, the second engagement axis 6*b* of the guide member 6 is pressed into and engaged with the second notch 4*b*-1 provided in the engagement part 4*b* of the plug 4.

Figure 4A:
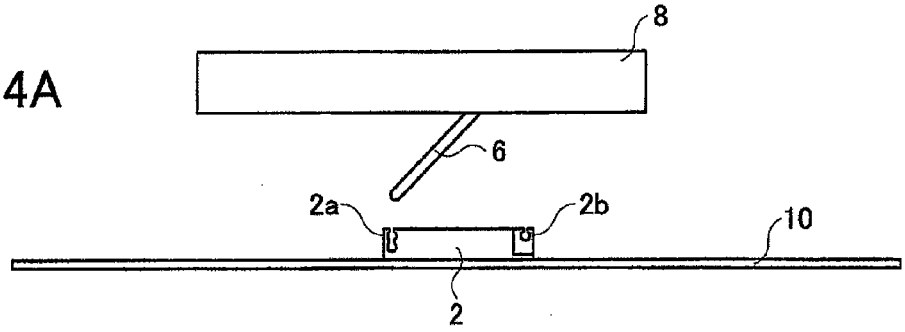
FIGS. 4A, 4B and 4C are views corresponding to FIGS. 3A, 3B and 3C, respectively, and illustrating a state where a second engagement axis is engaged with a second notch of the plug.
Figure 4B:
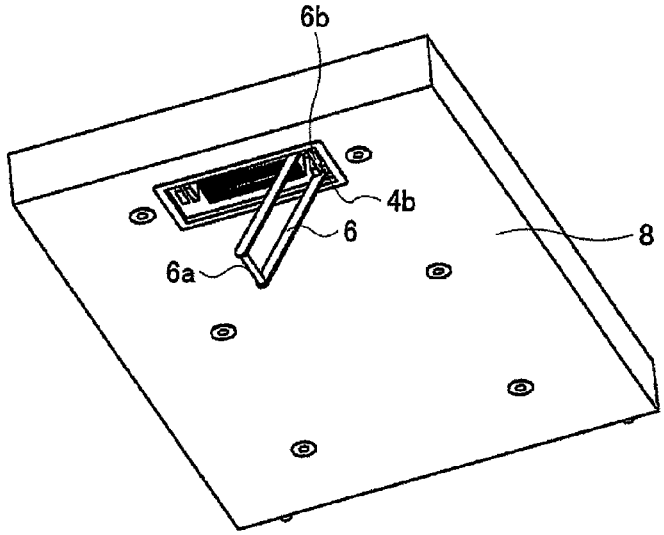
Figure 4C:
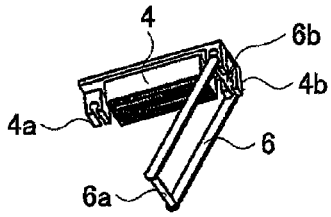

FIGS. 4A, 4B and 4C are views illustrating the state where the second engagement axis 6*b* is engaged with the second notch 4*b*-1 of the plug 4. FIGS. 4A, 4B and 4C are views corresponding to FIGS. 3A, 3B and 3C, respectively. As illustrated in FIG. 2, the second notch 4*b*-1 and the third notch 4*b*-2 are formed continuously. However, in the state illustrated in FIG. 3, the second engagement axis 6*b* is pressed into the position of the second notch 4*b*-1 and is not in engagement with the third notch 4*b*-2. The guide member 6 is set in a state where the guide member 6 hangs underneath the plug 4 in a state where the second engagement axis 6*b* is engaged with and supported by the second notch 4*b*-1. Accordingly, the first engagement axis 6*a* of the guide member 6 hangs from the back surface of the module 8, and the first engagement axis 6*a* of the guide member 6 can be visually recognized easily from an obliquely upward side of the module 8.

Thus, the first engagement axis 6*a* is pressed into the fourth notch 2*a*-1 provided in the engagement part 2*a* of the jack 2 to cause the first engagement axis 6*a* to be engaged with the fourth notch 2*a*-1 while visually recognizing the first engagement axis 6*a* of the guide member 6 that remarkably hangs from the back surface of the module 8.

Figure 5A:
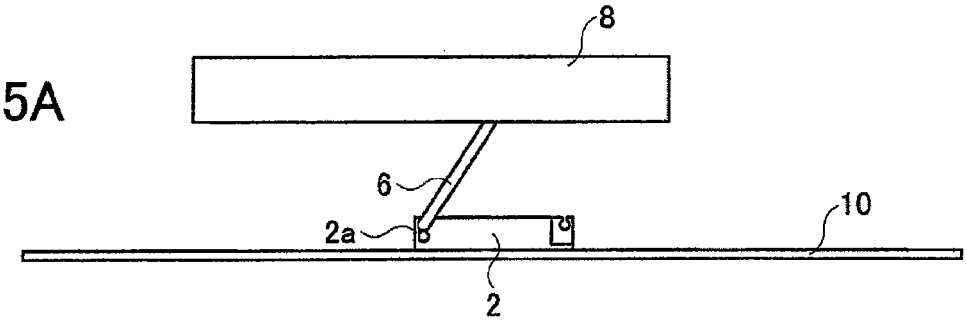
FIGS. 5A, 5B and 5C are views illustrating a state where a first engagement axis is engaged with a fourth notch of a jack.
Figure 5B:
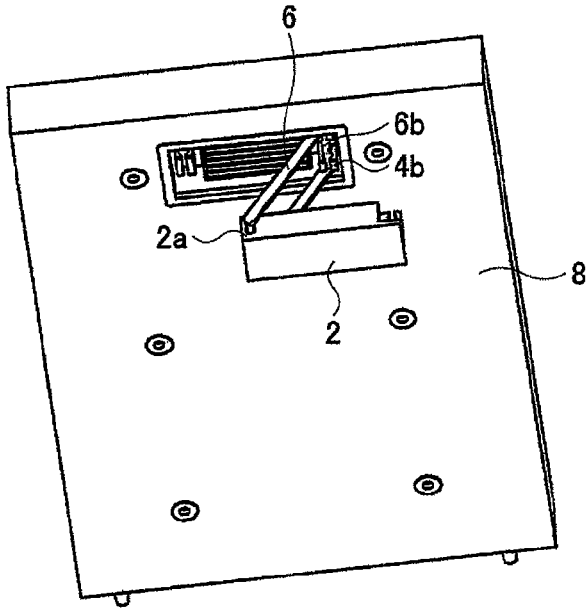
Figure 5C:
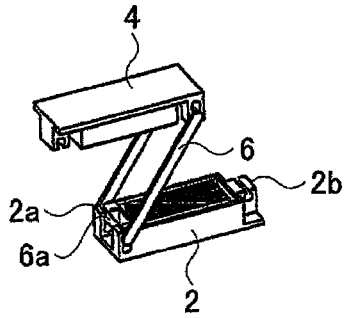
Figure 6:
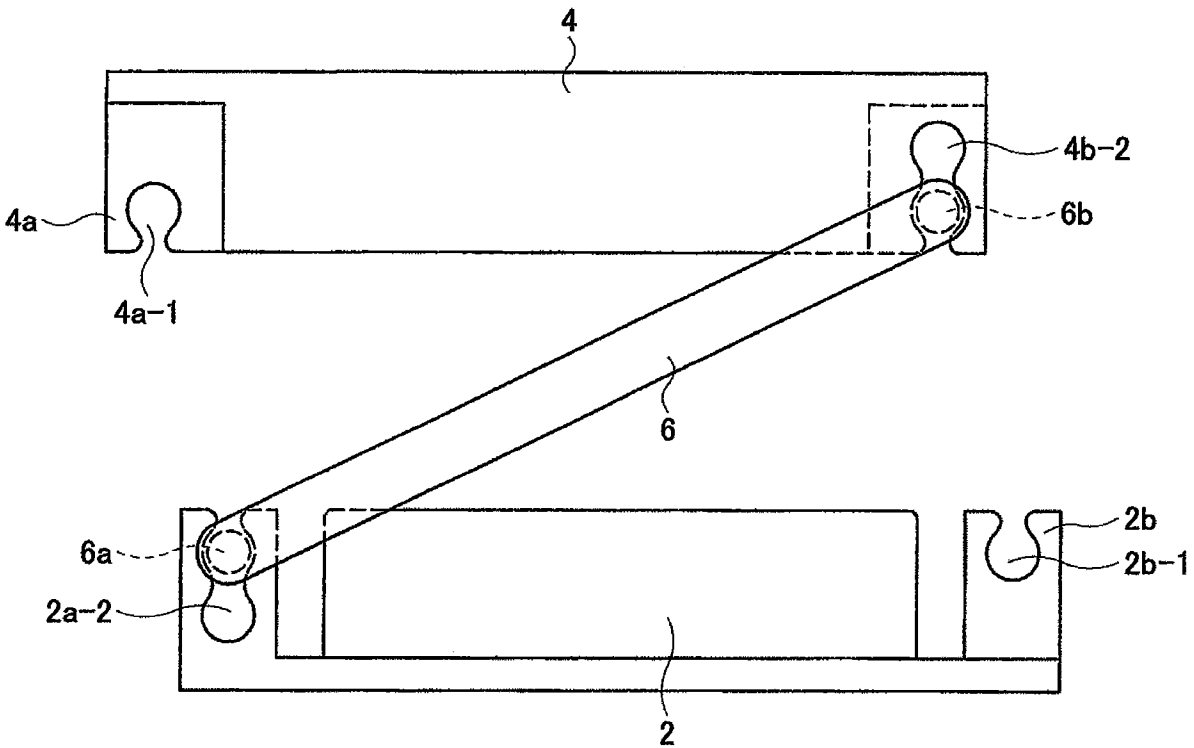
FIG. 6 is a side view illustrating positions of the first and second engagement axes of a guide member in the stated illustrated in FIGS. 5*a*, 5B and 5C.

FIGS. 5A, 5B and 5C are views illustrating a state where the first engagement axis 6*a* is engaged with the fourth notch 2*a*-1 of the jack 2. FIGS. 5A, 5B and 5C are views corresponding to FIGS. 3A, 3B and 3C, respectively. Although the fourth notch 2*a*-1 and the fifth notch 2*a*-2 are continuously formed in the engagement part 2*a* of the jack 2 as illustrated in FIG. 2, the first engagement axis 6*a* is pressed into a position where the fourth notch 2*a*-1 lies and are not in engagement with the fifth notch 2*a*-2 in the state illustrated in FIGS. 5A, 5B and 5C. FIG. 6 is a side view illustrating positions of the first and second engagement axes 6*a* and 6*b* of the guide member 6 in the stated illustrated in FIGS. 5*a*, 5B and 5C. The first engagement axis 6*a* of the guide member 6 is engaged with the fourth notch 2*a*-1 of the jack 2, and the second engagement axis 6*b* is engaged with the second notch 4*b*-1 of the plug 4.

In the state illustrated in FIGS. 5A, 5B and 5C and FIG. 6, the jack 2 and the plug 4 (that is, the circuit board 10 and the module 8) are relatively movable (rotatable) with respect to the first engagement axis 6*a* and the second engagement axis 6*b* of the guide member 6 so that they move closer to each other. Because the jack 2 and the plug 4 (that is, the circuit board 10 and the module 8) are supported by the first and second engagement axes 6*a* and 6*b*, respectively, the jack 2 and the plug 4 (that is, the circuit board 10 and the module 8) can incline in a direction perpendicular to the first and second axes 6*a* and 6*b*, but cannot incline in other directions. Accordingly, the module 8 (plug 4) is movable toward the circuit board 10 (jack 2) while maintaining them parallel to each other as illustrated in FIGS. 7A, 7B and 7C.

Figure 7A:
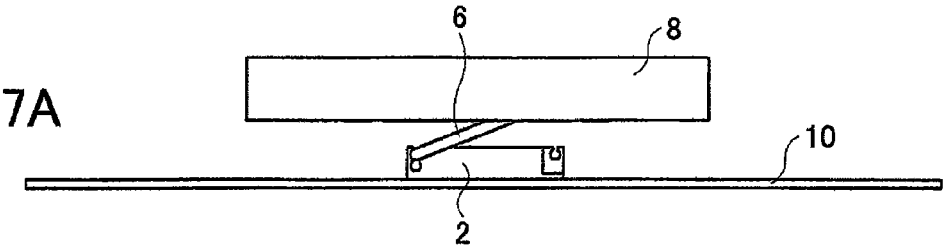
FIGS. 7A, 7B and 7C are views illustrating a state in the middle of moving the module toward the circuit board.
Figure 7B:
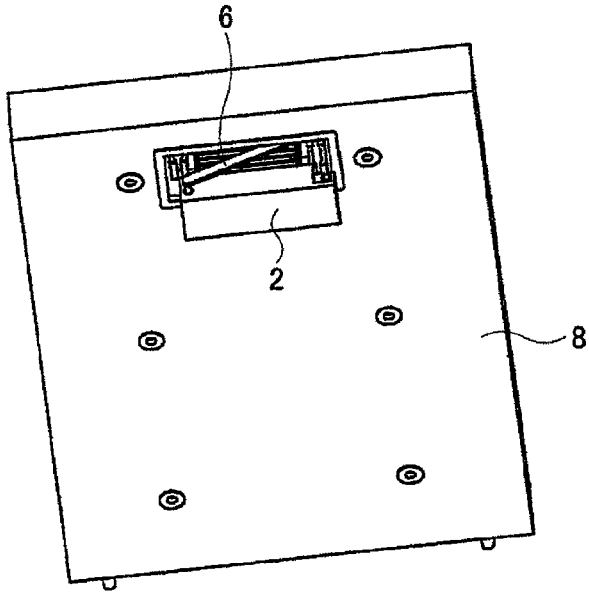
Figure 7C:
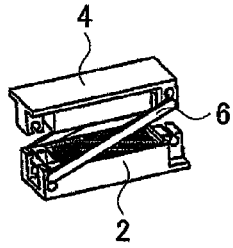
Figure 8A:
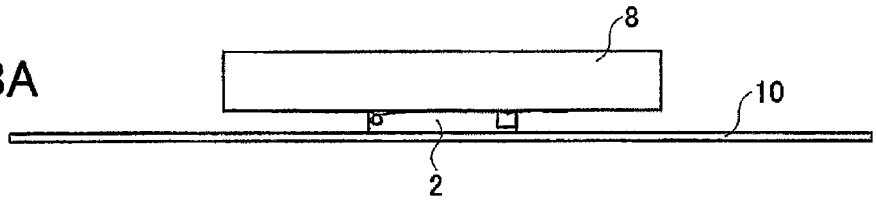
FIGS. 8A, 8B and 8C are views illustrating a state where an end surface of the plug reaches an end surface of the jack.
Figure 8B:
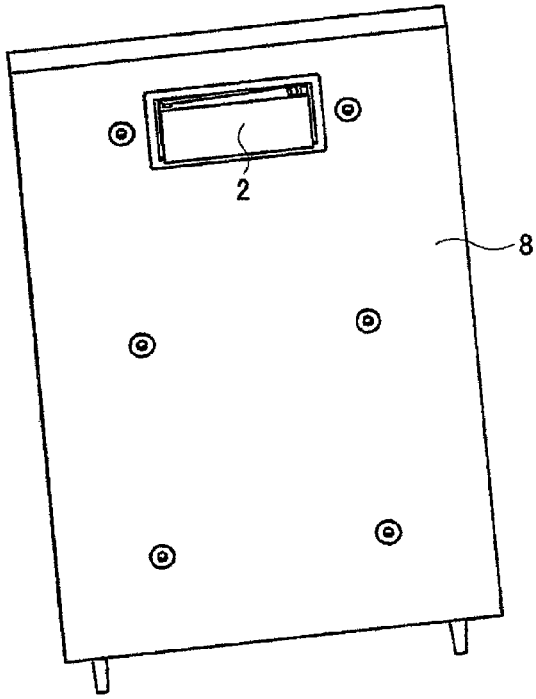
Figure 8C:
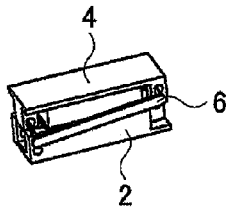

When the module 8 (plug 4) is further moved toward the circuit board 10 (jack 2) from the state illustrated in FIGS. 7A, 7B and 7C, the end surface of the plug 4 reaches the end surface of the jack 2 as illustrated in FIGS. 8A, 8B and 8C. In this state, the plug 4 is accurately positioned with respect to the jack 2. That is, because the plug 4 and the jack 2 are mutually supported by the first and second engagement axes 6*a* and 6*b*, the relative positional relationship in the connecting direction (the direction of allow A), when the plug 4 and the jack 2 is positioned parallel to each other, is determined depending on a distance between the plug 4 and the jack 2. Moreover, the plug and the jack are not able to move in directions other than the connecting direction, and also not able to incline. Accordingly, if the distance between the first engagement axis 6*a* and the second engagement axis 6*b* is previously set to an appropriate value, the plug 4 can be accurately positioned at the connecting position with respect to the jack 2 in the position where the distance between the plug 4 and the jack 2 is zero. Such a state is illustrated in FIGS. 8A, 8B and 8C.

Figure 9:
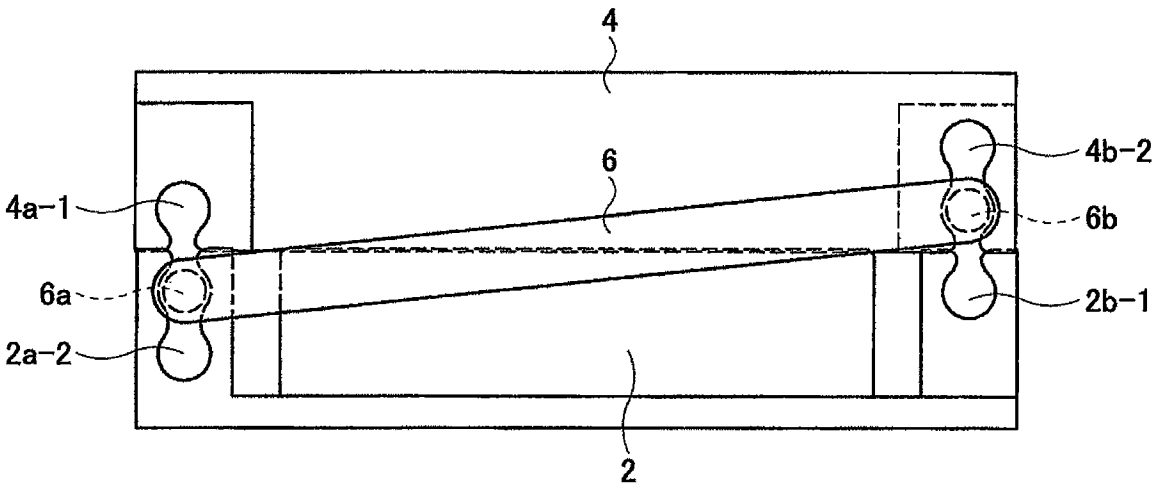
FIG. 9 is a side view illustrating positions of engagement axes of a guide member in the state illustrated in FIGS. 8A, 8B and 8C.
Figure 10:
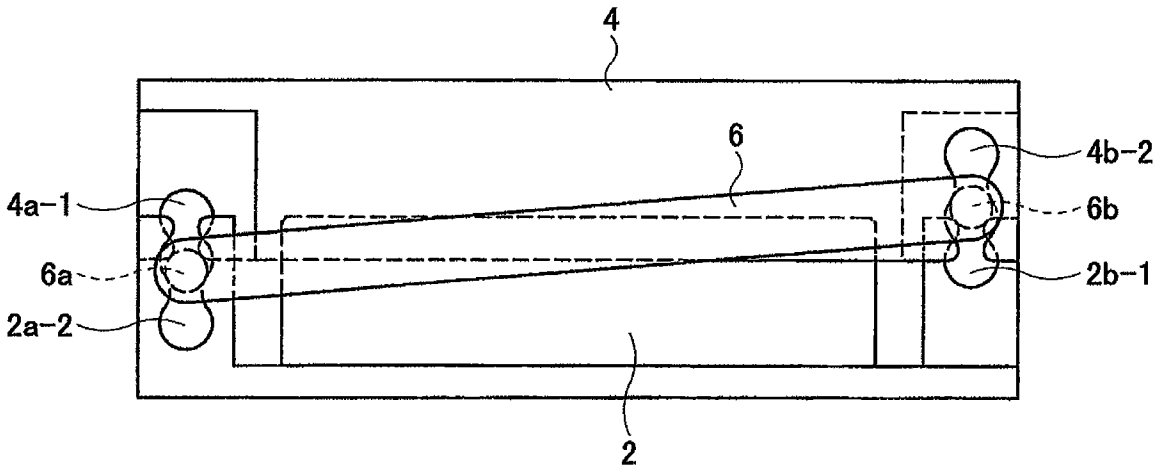
FIG. 10 is a side view illustrating positions of the engagement axes of the guide member in the middle of inserting the plug into the jack.

In the state illustrated in FIGS. 8A, 8B and 8C, the first engagement axis 6*a* of the guide member 6 is engaged with the fourth notch 2*a*-1 of the jack 2, and the second engagement axis 6*b* of the guide member 6 is merely engaged with the second notch 4*b*-1 of the plug 4. FIG. 9 is a side view illustrating positions of the first and second engagement axes 6*a* and 6*b* of the guide member 6 illustrated in FIGS. 8A, 8B and 8C. As mentioned above, the first engagement axis 6*a* of the guide member 6 is engaged with the fourth notch 2*a*-1 of the jack 2, and the second engagement axis 6*b* is engaged with the second notch 4*b*-1 of the plug 4.

In order to insert and connect the plug 4 to the jack 2, plug 4 must be pressed into the jack 3. Thus, when the plug 4 is pressed into the jack 2 from the state illustrated in FIGS. 8A, 8B and 8C, the first engagement axis 6*a* of the guide member 6 is pressed by the engagement part 4*a* of the plug 4 and moves toward the fifth notch 2*a*-2 connected to the fourth notch 2*a*-1. Similarly, the second engagement axis 6*b* of the guide member 6 is pressed by the engagement part 2*b* of the jack 2 and moves toward the third notch 4*b*-2 connected to the second notch 4*b*-1. Then, as illustrated in FIG. 11, the first engagement axis 6*a* of the guide member 6 is pressed into and engaged with the fifth notch 2*a*-2 of the jack 2, and the second engagement axis 6*b* of the guide member 6 is pressed into and engaged with the third notch 4*b*-2 of the plug 4.

Figure 11:
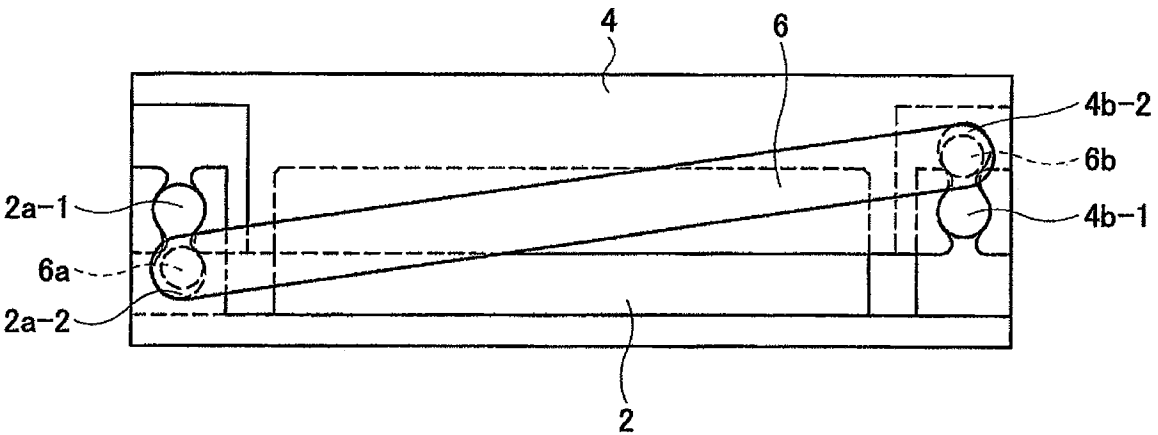
FIG. 11 is a side view illustrating positions of the engagement axes of the guide member in the middle of inserting the plug into the jack.

In the state illustrated in FIG. 11, the plug 4 is not completely inserted in the jack 2. That is, the plug 4 has not been pressed into the jack 2 by a distance corresponding to the size (diameter) of the first and second engagement axes 6*a* and 6*b*.

Figure 12A:
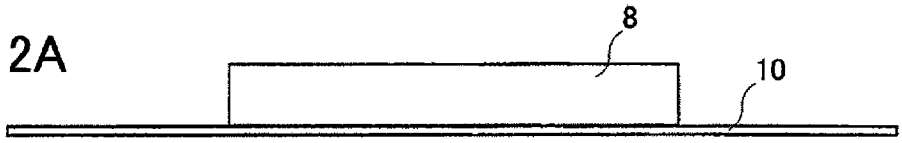
FIGS. 12A, 12B and 12C are views illustrating a state where the module is connected to the circuit board.
Figure 12B:
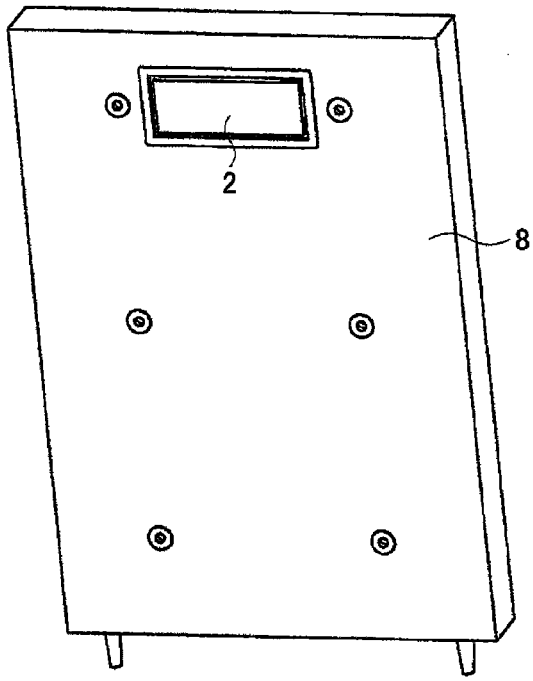
Figure 12C:
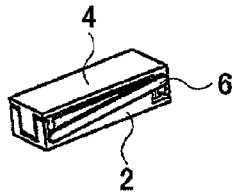

Thus, in order to completely insert the plug 4 into the jack 2, the first notch 4*a*-1 is provided in the engagement part 4*a* of the plug 4, and the sixth notch 2*b*-1 is provided in the engagement part 2*b* of the jack 2. That is, when the plug 4 is further pressed toward the jack 2 from the state where the first engagement axis 6*a* is pressed into the fifth notch 2*a*-2 and the second engagement axis 6*b* is pressed into the third notch 4*b*-2, the first notch 4*a*-1 of the engagement part 4*a* of the plug 4 moves downward and the first engagement axis 6*a* of the guide member 6 is pressed into and engaged with the first notch 4*a*-1. At the same time, the second engagement axis 6*a* of the guide member 6 moves downward, and is pressed into and engaged with the sixth notch 2*b*-1 of the engagement part 2*b* of the jack 2. Thereby, as illustrated in FIGS. 12A, 12B and 12C, it is set in a state where the plug 4 is completely inserted into the jack 2, and set in a state where the module 8 is connected to the circuit board 10.

Figure 13:
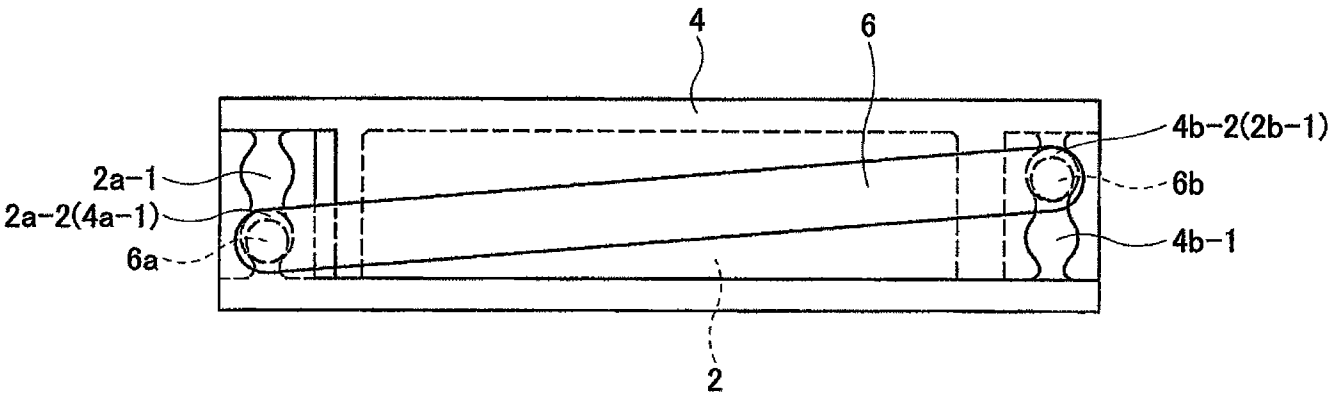
FIG. 13 is a side view illustrating positions of the engagement axes of the guide member in a state where the plug is completely inserted in the jack.

FIG. 13 is a view illustrating positions of the first and second engagement axes 6*a* and 6*b* of the guide member 6 in the state where the plug 4 is completely inserted in the jack 2. The first engagement axis 6*a* of the guide member 6 is pressed into and engaged with the fifth notch 2*a*-2 formed in a deep portion of the fourth notch 2*a*-1, and the second engagement axis 6*b* of the guide member 6 is pressed into and engaged with the third notch 4*b*-2 formed in a deep portion of the second notch 4*b*-1.

As mentioned above, according to the present embodiment, the plug 4 can be positioned accurately by guiding the plug 4 to the connecting position by coupling the jack 2 and the plug 4 using the guide member 6 and moving the plug 4 toward the jack 2. Because, the moving direction of the plug 4 with respect to the jack 2 is restricted by the guide member 6, the plug 4 can be inserted into the jack along the connecting direction of the connector. Moreover, because the connecting operation is performed after the guide member 6 is connected to both the jack 2 and the plug 4, a connection in a wrong direction (for example, a direction different by 90 degrees) can be prevented.

Figure 14:
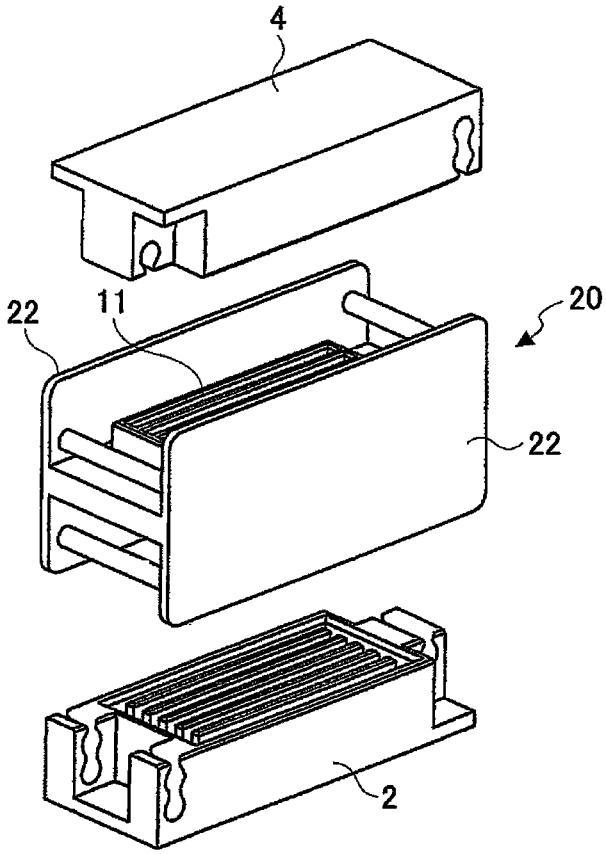
FIG. 14 is a perspective view of a connector according to a second embodiment.

A description will be given of a connector according to a second embodiment. FIG. 14 is a perspective view of the connector according to the second embodiment. In FIG. 14, parts that are the same as the parts illustrated in FIG. 1 are given the same reference numerals, and descriptions thereof will be omitted.

The connector according to the second embodiment includes a jack 2, a plug 4 and a relay guide member 20. That is, the guide member 6 in the connector illustrated in FIG. 1 is replaced by the relay guide member 20. The relay guide member 20 has the same function to guide the insertion of the plug 4 into the jack 2 as the guide member 6. Because the relay guide member 20 has a predetermined thickness and is placed between the plug 4 and the jack 2, when the plug 4 is connected to the jack 2, the plug 4 separates from the jack 2 by a distance corresponding to the thickness of the relay guide member 20. Thereby, the distance between the plug 4 and the jack 2 can be set large when the plug 4 and the jack 2 are connected to each other. In a case where a component having a large height is arranged on the mount surface of the circuit board, the height of the connector can be increased, when the plug 4 and the jack 2 are connected, by using the relay guide member 20. Thus, a connection can be achieved by setting a distance between two circuit boards to be larger than the height of the component.

Figure 15:
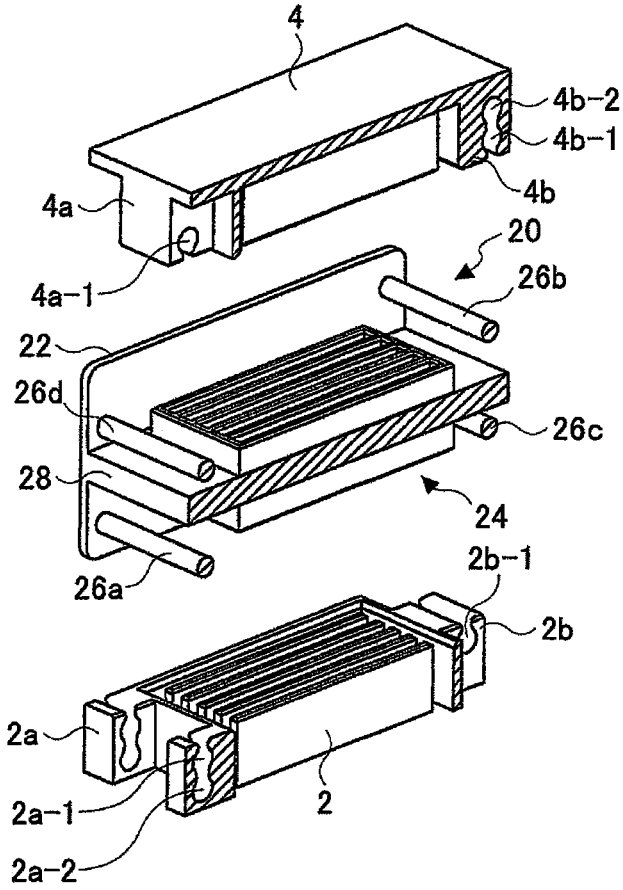
FIG. 15 is a cross-sectional perspective view of the connector illustrated in FIG. 14.

FIG. 15 is a cross-sectional perspective view of the connector illustrated in FIG. 14. The relay guide member 20 includes two side plates 22, a relay connection part 24 arranged between the side plates 22, and four engagement axes extending between the side plates 22, which are a first engagement axis 26*d*, a second engagement axis 26*b*, a third engagement axis 26*a* and a fourth engagement axis 26*c*.

Electrode terminals are arranged inside the relay connection part 24. An upper portion of the relay connection part 24 is configured to fit to the plug 4 and a lower portion of the relay connection part 24 is configured to fit to the jack 2. Accordingly, when the plug 4 is connected to the upper portion of the relay connection part 24 and the lower portion of the relay connection part 24 is connected to the jack 2, the electrode terminals of the plug 4 are electrically connected to the electrode terminals of the jack 2 through relay electrode terminals provided inside the relay connection part 24, thereby serving as a connector. That is, the upper portion of the relay connection part 24 has the same connection structure as the jack 2 and the lower portion of the relay connection part 24 has the same connection structure as the plug 4.

The relay connection part 24 is attached to a support plate 28 extending in the middle portion between the two side plates 22. The first engagement axis 26*d* is provided in the vicinity of an end of the relay connection part 24 above the support plate 28. The first engagement axis 26*d* is supported by the two side plates 22, and extends between the side plates 22. The second engagement axis 26*b* is provided in the vicinity of the other end of the relay connection part 24 above the support plate 28. The second engagement axis 26*b* is supported by the two side plates 22, and extends between the side plates 22. The third engagement axis 26*a* is provided in the vicinity of an end of the relay connection part 24 under the support plate 28. The third engagement axis 26*a* is supported by the two side plates 22 and extends between the side plates 22. The fourth engagement axis 26*c* is provided in the vicinity of the other end of the relay connection part 24 under the support plate 28. The fourth engagement axis 26*c* is supported by the two side plates 22 and extends between the side plates 22.

Figure 16A:
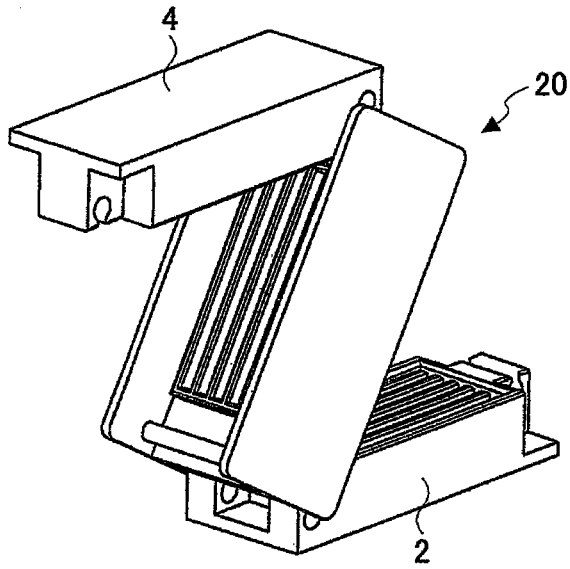
FIGS. 16A and 16B are views illustrating a state where engagement axes of a relay guide member are engaged with notches of an engagement part of the plug.
Figure 16B:
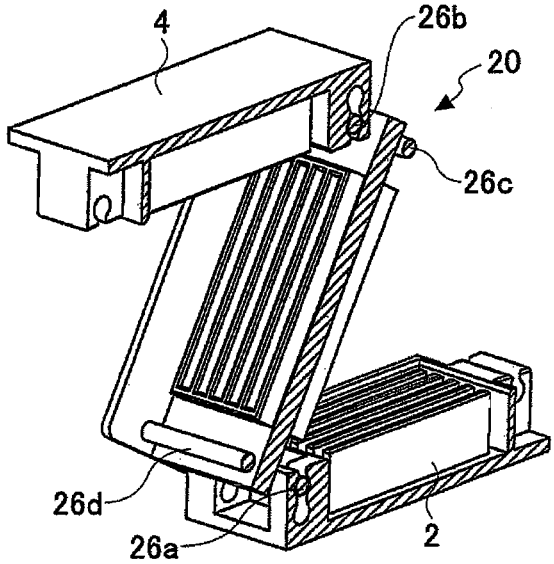

A description is given below of an operation of connecting the plug 4 to the jack 2 using the relay connection part 24. First, as illustrated in FIGS. 16A and 16B, the second engagement axis 26*b* of the relay guide member 20 is pressed into and engaged with the second notch 4*b*-1 of the engagement part 4*b* of the plug 4. Then, the third engagement axis 26*a* of the relay guide member 20 is pressed into and engaged with the fourth notch 2*a*-1 of the engagement part 2*a* of the jack 2. This operation is the same as the operation illustrated in FIGS. 4A, 4B and 4C and FIGS. 5A, 5B and 5C in the first embodiment.

Figure 17A:
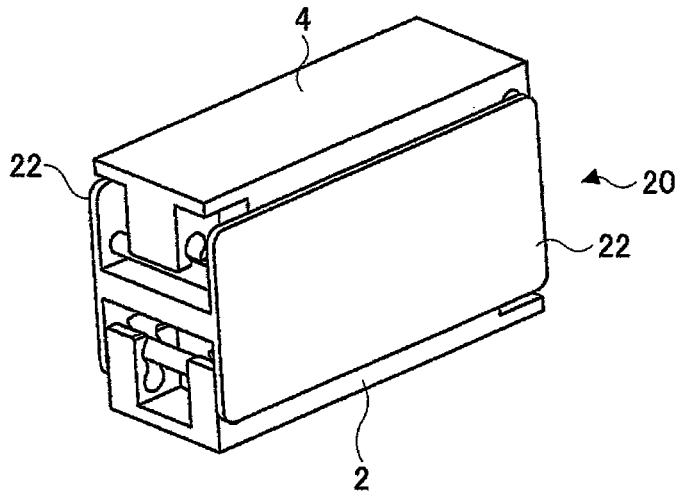
FIGS. 17A and 17B are views illustrating a state where a relay connection part is stacked on the jack and the plug is further stacked on the relay connection part.
Figure 17B:
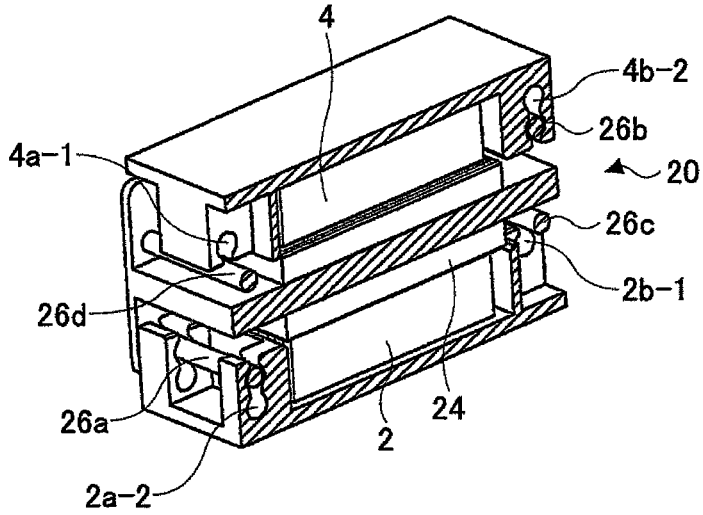

Then, as illustrated in FIGS. 17A and 17B, the relay connection part 20 is stacked on the jack 2 and the plug 4 is stacked on the plug 4. At this time, because the relay guide member 20 is rotatably supported by the third engagement axis 26*a* with respect to the jack 2, the jack 2 can be positioned at a predetermined position by merely rotating the relay guide member 20 with respect to the jack 2 about the third engagement axis 26*a* as a center of rotation. That is, the relay guide member 20 is automatically guided to the connecting position to the jack 2. Similarly, because the plug 4 is rotatably supported by the second engagement axis 26*b* with respect to the relay guide member 20, the relay guide member 20 can be positioned at a predetermined position by merely rotating the plug 4 with respect to the relay guide member 20 about the second engagement axis 26*b* as a center of rotation. That is, the plug 4 is automatically guided to the connecting position to the relay guide member 20.

Figure 18A:
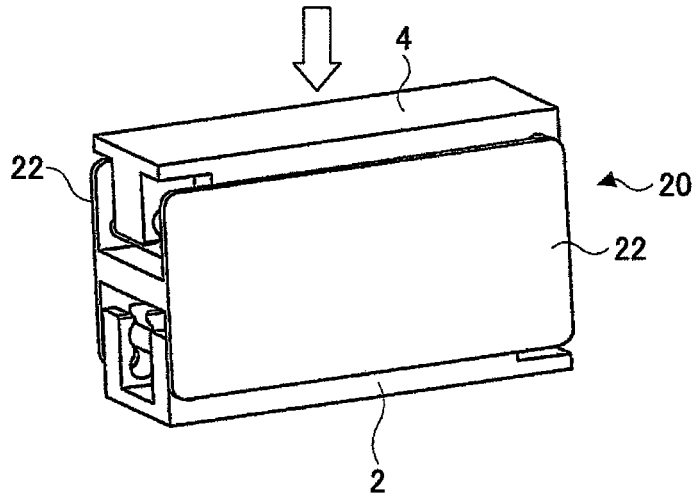
FIGS. 18A and 18B are views illustrating a state where the plug is pressed toward the jack through the relay guide member.
Figure 18B:
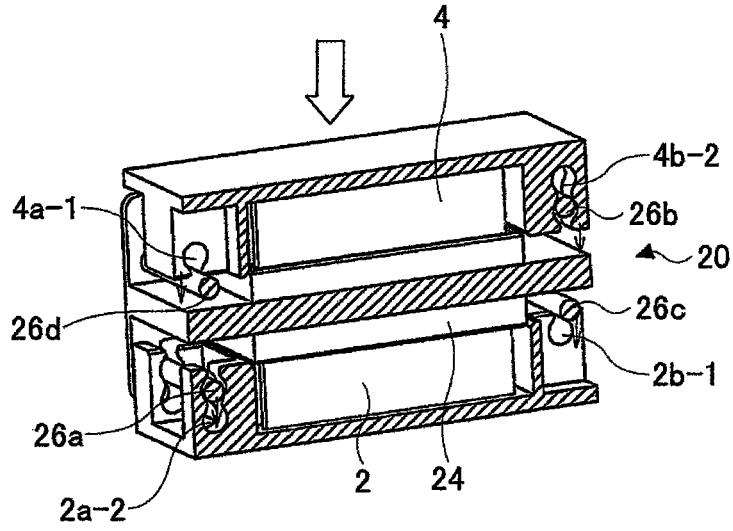

After the plug 4 and the relay guide member 20 are arranged on the jack 2 in a stacked state, the plug 4 is pressed toward the jack 2 as illustrated in FIGS. 18A and 18B. When the plug 4 is pressed, the first axis 26*d* of the relay guide member 20 is pressed into the first notch 4*a*-1 of the engagement part 4 of the plug 4, and simultaneously, the second axis 26*b* of the relay guide member 20 is pressed into the third notch 4*b*-2 from the second notch 4*b*-1 of the engagement part 4*b* of the plug 4. Thereby, the plug 4 is inserted into the relay connection part 24 of the relay guide member 20, and the connection terminals inside the plug 4 are connected to the connection terminals of the relay connection part 24.

Figure 19A:
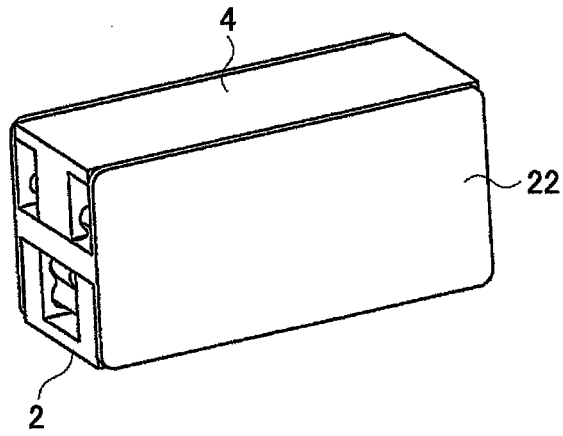
FIGS. 19A and 19B are views illustrating a state where the plug is connected to the jack through the relay connection part.
Figure 19B:
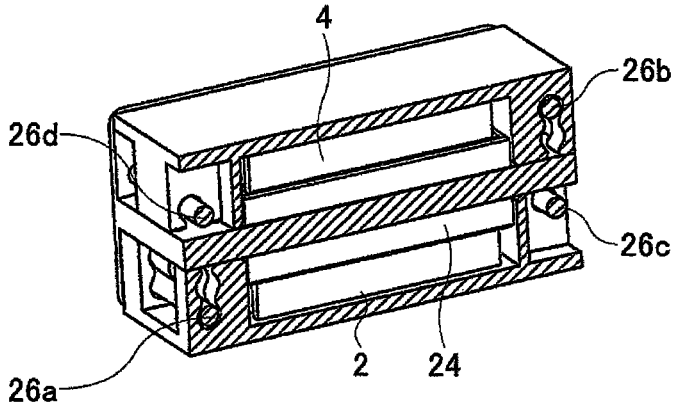

When the plug 4 is pressed further, the relay guide member 20 is pressed against the jack 2. Thereby, fourth engagement axis 26*c* of the relay guide member 20 is pressed into the sixth notch 2*b*-1 of the engagement part 2*b* of the jack 2, and the third engagement axis 26*a* of the relay guide member 20 is pressed into the fifth notch 2*a*-2 from the fourth notch 2*a*-1 of the engagement part 2*a* of the jack 2. Thereby, as illustrated in FIGS. 19A and 19B, the relay connection part 24 of the relay guide member 20 is inserted into the jack 2, and the connection terminal inside the relay connection part 24 are connected to the connection terminals of the jack 2. According to the above mentioned operation, the plug 4 is connected to the jack 2 through the relay connection part 24.

As mentioned above, according to the present embodiment, the plug 4 can be positioned accurately by guiding the relay guide member 20 to the connecting position of the jack 2 by moving the plug 4 toward the jack 2 after coupling the jack 2 and the plug 4 through the relay guide member 20, and the relay guide member 20 can be positioned accurately by guiding the relay guide member 20 to the connecting position of the jack 2. Because the moving direction of the plug 4 with respect to the relay guide member 20 and the moving direction of the relay guide member 20 with respect to the jack 2 are restricted, the plug 4 can be inserted into the relay guide member 20 along the connecting direction of the connector and the relay guide member 20 can be inserted into the jack 2.

Because the plug 4 is connected to the jack 2 through the relay guide member 20, the height of the connector is increased by a height corresponding to the thickness of the relay connection part 24 of the relay guide member 20. Therefore, the height of the connector can be increased by using the relay guide member 20. In addition, the thickness of the relay connection part 24 of the relay guide member 20 can be set to an arbitrary thickness, and may be previously set to be a desired height.

All examples and conditional language recited herein are intended for pedagogical purposes to aid the reader in understanding the principles of the invention and the concepts contributed by the inventor to furthering the art, and are to be construed a being without limitation to such specifically recited examples and conditions, nor does the organization of such examples in the specification relates to a showing of the superiority and inferiority of the invention. Although the embodiment(s) of the present invention (s) has(have) been described in detail, it should be understood that the various changes, substitutions, and alterations could be made hereto without departing from the spirit and scope of the invention.

What is claimed is:

1. A connector comprising:

a plug including a plurality of first electrode terminals arranged therein, the plug having a first engagement part on a first end side thereof in a direction of arrangement of the plurality of first electrode terminals and a second engagement part on a second end side thereof opposite to the first end side;

a jack including a plurality of second electrode terminals arranged therein, the plurality of second electrode terminals being configured to be connected to the plurality of first electrode terminals, the jack having a third engagement part on a third end side thereof in a direction of arrangement of the plurality of second electrode terminals and a fourth engagement part on fourth end side thereof opposite to the third end side; and a guide member having a fifth engagement part and a sixth engagement part, the fifth engagement part being configured to engage with the first engagement part of the plug and the third engagement part of the jack, the sixth engagement part being configured to engage with the second engagement part of the plug and the fourth engagement part of the jack, wherein, when connecting the plug and the jack, the fifth engagement part is supported by the first and third engagement parts, and the sixth engagement part is supported by the second and fourth engagement parts.

2. The connector as claimed in claim 1, wherein the fifth engagement part of the guide member includes a first engagement axis, and the sixth engagement part includes a second engagement axis parallel to the first engagement axis.

3. A connector comprising:

a plug including a plurality of first electrode terminals arranged therein, the plug having a first engagement part on a first end side thereof in a direction of arrangement of the plurality of first electrode terminals and a second engagement part on a second end side thereof opposite to the first end side;

a jack including a plurality of second electrode terminals arranged therein, the plurality of second electrode terminals being configured to be connected to the plurality of first electrode terminals, the jack having a third engagement part on a third end side thereof in a direction of arrangement of the plurality of second electrode terminals and a fourth engagement part on a fourth end side thereof opposite to the third end side; and a guide member having a fifth engagement part and a sixth engagement part, the fifth engagement part being configured to engage with the first engagement part of the plug and the third engagement part of the jack, the sixth engagement part being configured to engage with the second engagement part of the plug and the fourth engagement part of the jack, wherein the fifth engagement part of the guide member includes a first engagement axis, and the sixth engagement part includes a second engagement axis parallel to the first engagement axis, and wherein the third engagement part of the jack includes two engagement parts separated from each other in a direction perpendicular to the direction of arrangement of the plurality of second electrode terminals;

the second engagement part of the plug includes two engagement parts separated from each other in a direction perpendicular to the direction of arrangement of the plurality of first electrode terminals; and in a state where the plug is connected to the jack, the first engagement part of the plug is positioned between the two engagement parts of the third engagement part of the jack, and the fourth engagement part of the jack is positioned between the two engagement parts of the second engagement part of the plug.

4. The connector as claimed in claim 3, wherein the first engagement part of the plug includes a first notch configured to receive and engage with the first engagement axis;

the second engagement part of the plug includes a second notch configured to receive and engage with the second engagement axis and a third notch formed to connect to the second notch;

the third engagement part of the jack includes a fourth notch configured to receive and engage with the first engagement axis and a fifth notch formed to connect to the fourth notch;

the fourth engagement part of the jack includes a sixth notch configured to receive and engage with the second engagement axis; and in the state where the plug is connected to the jack, the first engagement axis engages with the first notch and the fifth notch, and the second engagement axis engages with the third notch and the sixth notch.

5. A connecting method of the connector as claimed in claim 4, comprising:

engaging the second engagement axis of the guide member with the second notch of the plug, and engaging the first engagement axis of the guide member with the fourth notch of the jack;

moving the plug toward the jack to a connecting position by rotating the guide member about the first engagement axis and the second engagement axis with respect to the plug and the jack; and after the plug reaches the connecting position, pressing the plug toward the jack and inserting the plug into the jack so as to cause the first engagement axis of the guide member to engage with the first notch of the plug and the fifth notch of the jack and the second engagement axis of the guide member to engage with the sixth notch of the jack and the third notch of the plug.

6. A connector comprising:

a plug including a plurality of first electrode terminals arranged therein, the plug having a first engagement part on a first end side thereof in a direction of arrangement of the plurality of first electrode terminals and a second engagement part on a second end side thereof opposite to the first end side;

a jack including a plurality of second electrode terminals arranged therein, the plurality of second electrode terminals being configured to be connected to the plurality of first electrode terminals, the jack having a third engagement part on a third end side thereof in a direction of arrangement of the plurality of second electrode terminals and a fourth engagement part on a fourth end side thereof opposite to the third end side; and a guide member having a fifth engagement part and a sixth engagement part, the fifth engagement part being configured to engage with the first engagement part of the plug and the third engagement part of the jack, the sixth engagement part being configured to engage with the second engagement part of the plug and the fourth engagement part of the jack, wherein the guide member includes a relay connection part arranged between the fifth engagement part and the sixth engagement part;

the relay connection part includes a plurality of relay electrode terminals configured to be connected to the plurality of first electrode terminals of the plug and the plurality of second electrode terminals of the jack, respectively;

the plug is configured to be connected to one end side of the relay connection part and the jack is configured to be connected to another end side of the relay connection part;

the fifth engagement part of the guide member includes a first engagement axis and a third engagement axis parallel to the first engagement axis, the first engagement axis extending in a direction perpendicular to an extending direction of the plurality of relay electrode terminals; and the sixth engagement part of the guide member includes a second engagement axis and a fourth engagement axis parallel to the second engagement axis, the fourth engagement axis extending in the direction perpendicular to the extending direction of the plurality of relay electrode terminals.

7. The connector as claimed in claim 6, wherein the third engagement part of the jack includes two engagement parts separated from each other in a direction perpendicular to the direction of arrangement of the plurality of second electrode terminals;

the second engagement part of the plug includes two engagement parts separated from each other in a direction perpendicular to the direction of arrangement of the plurality of first electrode terminals; and in a state where the plug is connected to the relay connection part and the relay connection part is connected to the jack, the first engagement part of the plug is positioned between the two engagement parts of the third engagement part of the jack, and the fourth engagement part of the jack is positioned between the two engagement parts of the second engagement part of the plug.

8. The connector as claimed in claim 7, wherein the first engagement part of the plug includes a first notch configured to receive and engage with the first engagement axis;

the second engagement part of the plug includes a second notch configured to receive and engage with the second engagement axis and a third notch formed to connect to the second notch;

the third engagement part of the jack includes a fourth notch configured to receive and engage with the first engagement axis and a fifth notch formed to connect to the fourth notch;

the fourth engagement part of the jack includes a sixth notch configured to receive and engage with the second engagement axis; and in a state where the plug is connected to the relay connection part and the relay connection part is connected to the jack, the first engagement axis engages with the first notch and the fifth notch, the second engagement axis engages with the third notch, the third engagement axis engages with the fifth notch, and the fourth engagement axis engages with the sixth notch.

9. A connecting method of the connector as claimed in claim 8, comprising:

engaging the second engagement axis of the sixth engagement part of the guide member with the second notch of the plug, and engaging the third engagement axis of the fifth engagement part of the guide member with the fourth notch of the jack;

moving the plug and the guide member toward the jack to a connecting position by rotating the guide member about the first engagement axis and the second engagement axis with respect to the plug and the jack; and after the plug and the guide member reach the connecting position, pressing the plug toward the jack through the guide member and inserting the plug into the relay connection part of the guide member and the relay connection part into the jack so as to cause the first engagement axis of the fifth engagement part to engage with the first notch of the plug, the third engagement axis of the fifth engagement part to engage with the fifth notch of the jack, the fourth engagement axis of the sixth engagement part to engage with the third notch of the plug, and the fourth engagement axis of the sixth engagement part to engage with the sixth notch of the jack.

* * * * *